US009227402B2

(12) United States Patent
Domae

(10) Patent No.: US 9,227,402 B2
(45) Date of Patent: Jan. 5, 2016

(54) LIQUID JET HEAD AND LIQUID JET APPARATUS

(71) Applicant: SII PRINTEK INC., Chiba-shi, Chiba (JP)

(72) Inventor: Yoshinori Domae, Chiba (JP)

(73) Assignee: SII PRINTEK INC. (JP)

( * ) Notice: Subject to any disclaimer, the term of this patent is extended or adjusted under 35 U.S.C. 154(b) by 0 days.

(21) Appl. No.: 14/620,951

(22) Filed: Feb. 12, 2015

(65) Prior Publication Data

US 2015/0251422 A1 Sep. 10, 2015

(30) Foreign Application Priority Data

Mar. 7, 2014 (JP) ..... 2014-045506

(51) Int. Cl.
*B41J 2/045* (2006.01)
*B41J 2/14* (2006.01)

(52) U.S. Cl.
CPC ..... *B41J 2/14201* (2013.01); *B41J 2/14209* (2013.01)

(58) Field of Classification Search
CPC ..... B41J 2/005; B41J 2/045; B41J 2/135; B41J 2/14201
See application file for complete search history.

(56) References Cited

U.S. PATENT DOCUMENTS

| | | | | |
|---|---|---|---|---|
| 5,548,313 | A * | 8/1996 | Lee | 347/68 |
| 5,631,680 | A * | 5/1997 | Sugahara | 347/69 |
| 2002/0024557 | A1 * | 2/2002 | Matsumoto et al. | 347/42 |
| 2003/0011660 | A1 | 1/2003 | Nishi et al. | 347/68 |

FOREIGN PATENT DOCUMENTS

| | | |
|---|---|---|
| JP | 2000108349 | 4/2000 |
| JP | 2000185399 | 7/2000 |
| JP | 200188295 | 4/2001 |
| JP | 2002505972 | 2/2002 |
| JP | 2003507213 | 2/2003 |
| JP | 2003110159 | 4/2003 |
| JP | 2009119788 | 6/2009 |
| JP | 2009178959 | 8/2009 |
| JP | 2009/202455 | 9/2009 |
| JP | 2012111130 | 6/2012 |
| JP | 2012187863 | 10/2012 |

OTHER PUBLICATIONS

European Search Report issued Jul. 14, 2015 in Appln. No. EP 15 15 3348.

* cited by examiner

*Primary Examiner* — Geoffrey Mruk
(74) *Attorney, Agent, or Firm* — Adams & Wilks

(57) ABSTRACT

A liquid jet head has spaced-apart side walls that form alternating ejection channels and non-ejection channels. The side walls comprise two piezoelectric materials polarized in opposite directions and laminated together with a polarization boundary interposed between them. Upper and lower members are fixed to respective upper and lower ends of the side walls and overlie upper and lower ends of the channels. Electrodes on opposed wall surfaces of the side walls extend from the upper ends of the side walls to either the vicinity of the polarization boundary or to below the polarization boundary and above the lower ends of the side walls. The polarization boundary is positioned above one-half the depth of the channels to improving the driving efficiency of the piezoelectric body.

18 Claims, 6 Drawing Sheets

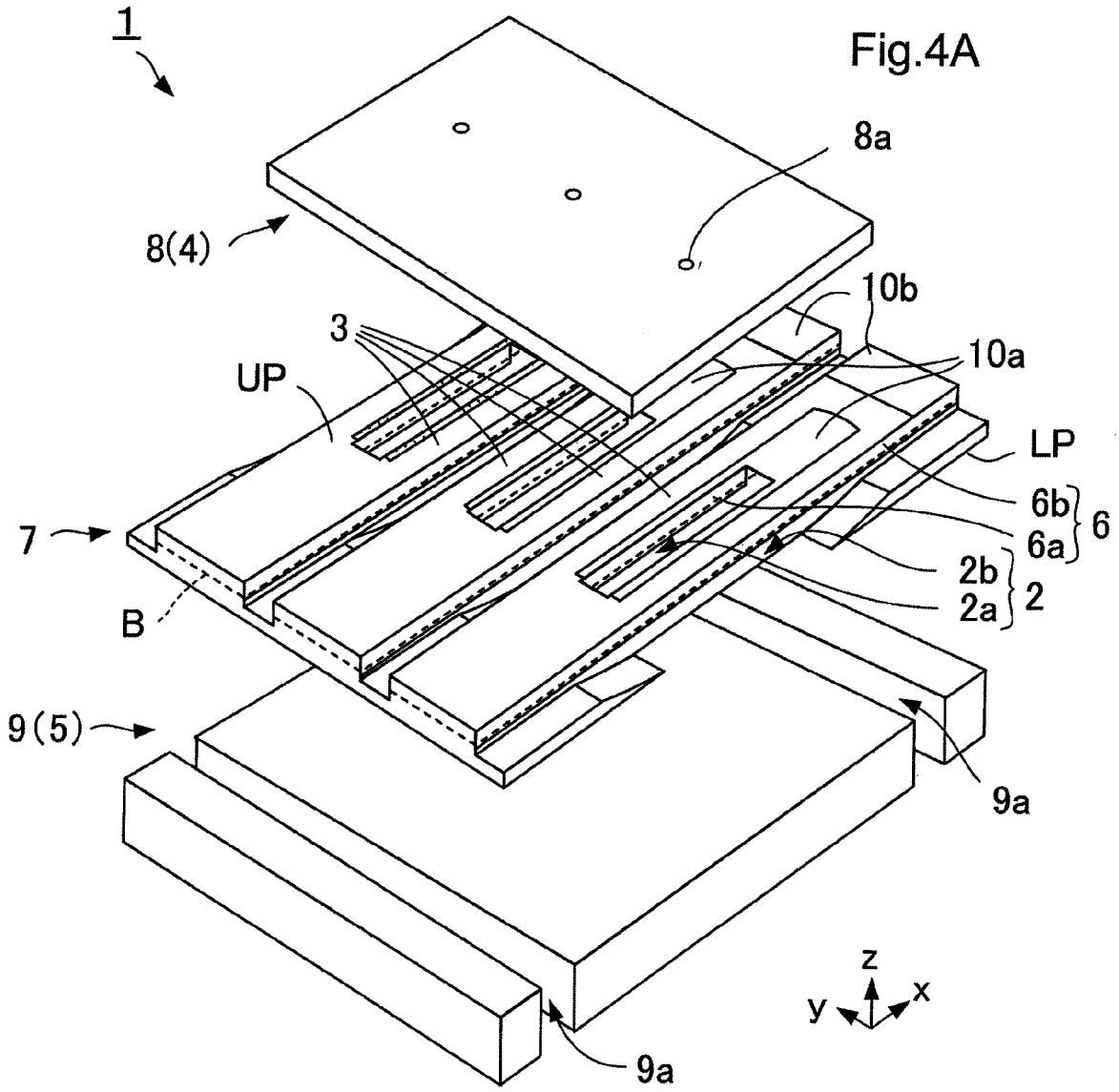
Fig.4B
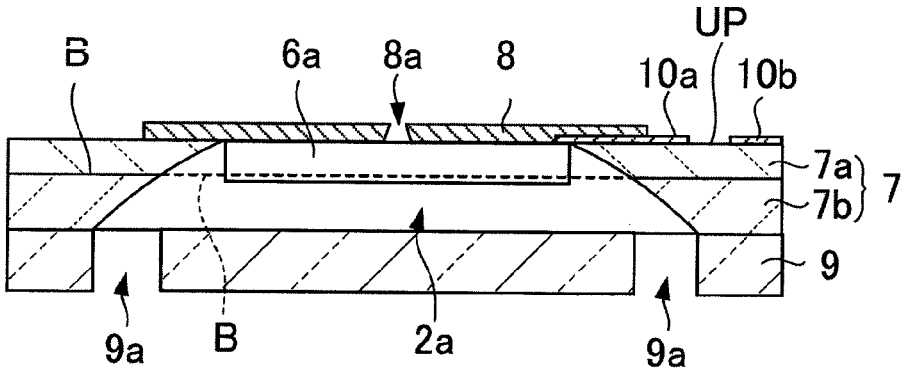

LIQUID JET HEAD AND LIQUID JET APPARATUS

BACKGROUND

1. Technical Field

The present invention relates to a liquid jet head and a liquid jet apparatus that jet and record liquid droplets on a recording medium.

2. Related Art

In recent years, liquid jet heads in an ink jet system have been used, which eject ink droplets on a recording paper or the like to record characters and figures, or eject a liquid material on a surface of an element substrate to form a functional thin film. This system introduces a liquid such as an ink or a liquid material from a liquid tank to a channel through a supply tube, applies a pressure to the liquid filled in the channel, and ejects the liquid through a nozzle that communicates with the channel, as liquid droplets. In ejecting the liquid droplets, this system moves the liquid jet head and/or the recording medium to record the characters and figures or to form a functional thin film or a three-dimensional structure having a predetermined shape.

FIG. 6 is a schematic cross-sectional view of jet channels 113 of a liquid jet apparatus described in JP 2001-88295 A. The liquid jet apparatus is a side shoot-type liquid jet apparatus in which an actuator substrate 100 made of a piezoelectric material, a nozzle plate 140, and a manifold member 132 are laminated. The actuator substrate 100 is made of a piezoelectric material, and the manifold member 132 is made of a synthetic resin. A plurality of the jet channels 113 is formed in the actuator substrate 100. The jet channels 113 have a long and narrow groove shape and penetrate in a thickness direction of the actuator substrate 100. Adjacent jet channels 113 are partitioned by a side wall 117. A drive electrode 119 is formed on an entire wall surface of the side wall 117. A pattern of an electric supply line (not illustrated) is provided on an upper end surface of the actuator substrate 100, and one end of the electric supply line is electrically connected to the drive electrode 119 on the wall surface and the other end is connected to a control circuit. The manifold member 132 includes a manifold flow path (not illustrated) that supplies a liquid to the jet channels 113, and a plurality of ink flow paths 134 that branches from the manifold flow path. The ink flow paths 134 of the manifold member 132 are bonded on the upper end surface of the actuator substrate 100 through an adhesive 138, respectively corresponding to the jet channels 113. The nozzle plate 140 includes nozzles that communicate with the jet channels 113, and is bonded on a lower end surface of the actuator substrate 100.

The side wall 117 of the actuator substrate 100 is uniformly polarized (P) in the thickness direction of the actuator substrate 100. A voltage is applied to drive electrodes 119*c* and 119*d* of a jet channel 113*a* to be driven. When drive electrodes 119*b* and 119*e* of two jet channels 113 adjacent to the jet channel 113*a* are grounded, both side walls 117*a* and 117*d* of the jet channel 113*a* to be driven are subjected to thickness slip deformation, and are deformed in a direction into which the volume of the jet channel 113*a* is increased. A side wall 137 of the manifold member 132 is deformed following the deformation of the side wall 117 of the jet channel 113, and is deformed in a direction into which the volume of the ink flow paths 134 is increased. Therefore, the liquid is drawn from the manifold flow path (not illustrated) to the jet channels 113. Next, the voltage applied to the drive electrodes 119*c* and 119*d* of the jet channel 113*a* is returned to (0) V, and the both side walls 117*a* and 117*d* of the jet channel 113*a* are returned to the shape before the deformation. At this time, a relatively large pressure is applied to the liquid, and the liquid droplets are jetted through a nozzle 118*a*.

JP 2003-110159 A describes an adhesive structure in which a thick piezoelectric ceramic plate and a thin piezoelectric ceramic plate adhere together through an adhesion layer. Polarization processing is applied to the thick piezoelectric ceramic plate and the thin piezoelectric ceramic plate in a vertical direction to a substrate surface, the polarization directions are caused to be opposite directions, and the two piezoelectric ceramic plates adhere together through the adhesive, so that the adhesive structure (laminated piezoelectric body substrate) is obtained. At that time, the roughness of a surface at a side opposite to an adhesion surface of the thin piezoelectric ceramic plate is made to 1 μm or less in arithmetic mean roughness (Ra), so that a bend or a waviness of the adhesive structure is decreased. Then, cutting is performed from a side of the thin piezoelectric ceramic plate into a depth in the middle of the thick piezoelectric ceramic plate, and a plurality of grooves, which is partitioned by side walls, is formed in parallel in an upper surface of the adhesive structure. An electrode for driving the side walls is formed on the entire wall surfaces of the side walls and bottom surfaces of the grooves using a vapor deposition method or a sputtering method. A top plate including a liquid supply path adheres to a top face of the adhesive structure. A nozzle plate including nozzles adheres to an end surface of the adhesive structure. The liquid jet head is configured, accordingly. When a drive signal is applied to the electrode installed on both wall surfaces of the side walls, the side walls are deformed, a pressure is applied to the liquid filled in the grooves, and liquid droplets are jet through the nozzles that communicate with the grooves.

In JP 2009-119788 A, JP 2009-178959 A, JP 2009-202455 A, JP 2012-111130 A, JP 2012-187863 A, and JP 2002-505972 W, liquid jet heads having a similar structure to the grooves and the side walls described in JP 2003-110159 A are described. That is, a laminated piezoelectric body substrate is formed, in which two piezoelectric body substrates polarized in mutually opposite directions adhere together, and a plurality of grooves partitioned by side walls is formed in parallel in the laminated piezoelectric body substrate. A drive electrode is formed on the entire wall surfaces of the side walls that configure the grooves. When a drive signal is applied to the drive electrode, the side walls are deformed, a pressure is applied to a liquid filled in the grooves, and liquid droplets are jet through nozzles that communicate with the grooves.

JP 2003-507213 W describes a jet channel, in which a plurality of grooves partitioned by side walls is formed in parallel in a surface of a piezoelectric body substrate, which is polarized in one direction, and a drive electrode is installed on upper half portions of wall surfaces of the side walls. When a drive signal is applied to the drive electrode, the upper half portions of the side walls is subjected to thickness slip deformation, and a pressure is applied to a liquid filled in the grooves, and liquid droplets are jet through nozzles that communicate with the grooves.

In the liquid jet apparatus described in JP 2001-88295 A, the adjacent jet channels 113 are partitioned by the side wall 117 to which the polarization processing is uniformly applied. The drive electrode 119 is formed on the entire wall surface of the side wall 117. In the liquid jet heads described in JP 2003-110159 A, JP 2009-119788 A, JP 2009-178959 A, JP 2009-202455 A, JP 2012-111130 A, JP 2012-187863 A, and JP 2002-505972 W, the piezoelectric materials having different polarization directions are laminated on the side walls that configure the jet channels, and the drive electrode is formed on the entire wall surfaces of the side walls. As a method of forming the electrode on the entire wall surfaces of the side walls, a plating method can be employed. However, the electrode formed by the plating method is deposited on the bottom surfaces of the grooves, in addition to the wall surfaces of the side walls. To alternately arrange ejection channels and non-ejection channels, and perform one-cycle driving of ejecting the liquid droplets through all of the ejection channels at one time, it is necessary to electrically divide the electrodes on the two wall surfaces. Therefore, manufacturing process steps become complicated and the number of man-hour is increased.

Meanwhile, in the jet channel described in JP 2003-507213 W, the electrode is formed on the upper half portions of the wall surfaces of the side walls. If a conductive material such as a metal material is deposited by an oblique vapor deposition method, electrically separated electrodes can be easily formed on two wall surfaces that face each other across the groove, without depositing the conductive material on the bottom surface of the groove. Therefore, an electrode separation step of electrically separating the electrodes deposited on the two wall surfaces is not necessary. However, with a demand of high densification of recording with the jet channel, the groove width of the grooves that configure the jet channel is narrowed. The oblique vapor deposition method requires a longer time to deposit the conductive material in the depth direction of the wall surface as the groove width becomes narrower, and productivity is reduced.

SUMMARY

A liquid jet head of the present invention includes a side wall installed between a channel and a channel, and in which two piezoelectric materials having mutually different polarization directions are laminated in a height direction, interposing a polarization boundary, an upper member fixed to an upper end of the side wall, and installed on upper portions of the channels, a lower member fixed to a lower end of the side wall and installed on lower portions of the channels, and an electrode installed on a wall surface of the side wall, wherein the polarization boundary is positioned above ½ a height of the side wall, and the electrode is installed from an upper end of the wall surface, to a vicinity of the polarization boundary, or below the polarization boundary and above a lower end of the wall surface.

Further, the channel includes an ejection channel that ejects liquid droplets, and a non-ejection channel that does not eject the liquid droplets, the side wall is installed between the ejection channel and the non-ejection channel, the electrode includes an individual electrode installed on the wall surface facing the non-ejection channel, and a common electrode installed on the wall surface facing the ejection channel, and the individual electrode is installed from the upper end of the wall surface of the non-ejection channel, to the polarization boundary, or below the polarization boundary and above the lower end of the wall surface of the non-ejection channel.

Further, mechanical strength of the upper member is lower than that of the lower member.

Further, the upper member is a nozzle plate in which a nozzle that ejects the liquid droplets is formed, and the lower member is a cover plate.

Further, the upper member is a cover plate, and the lower member is made of the piezoelectric material.

Further, the electrode is made of a conductive material formed by an oblique vapor deposition method.

A liquid jet apparatus of the present invention includes the liquid jet head, a moving mechanism that relatively moves the liquid jet head and a recording medium, a liquid supply tube that supplies a liquid to the liquid jet head, and a liquid tank that supplies the liquid to the liquid supply tube.

The liquid jet head according to the present invention includes a side wall installed between a channel and a channel, and in which two piezoelectric materials having mutually different polarization directions are laminated in a height direction, interposing a polarization boundary, an upper member fixed to an upper end of the side wall, and installed on upper portions of the channels, a lower member fixed to a lower end of the side wall and installed on lower portions of the channels, and an electrode installed on a wall surface of the side wall, in which the polarization boundary is positioned above ½ a height of the side wall, and the electrode is installed from an upper end of the wall surface, to a vicinity of the polarization boundary, or below the polarization boundary and above a lower end of the wall surface. Accordingly, the amount of displacement of the side wall can be caused to be a level sufficient to eject the liquid droplets.

BRIEF DESCRIPTION OF DRAWINGS

FIGS. 4A and 4B are explanatory diagrams of a liquid jet head according to a third embodiment of the present invention;

DETAILED DESCRIPTION

First Embodiment

Figure 1:
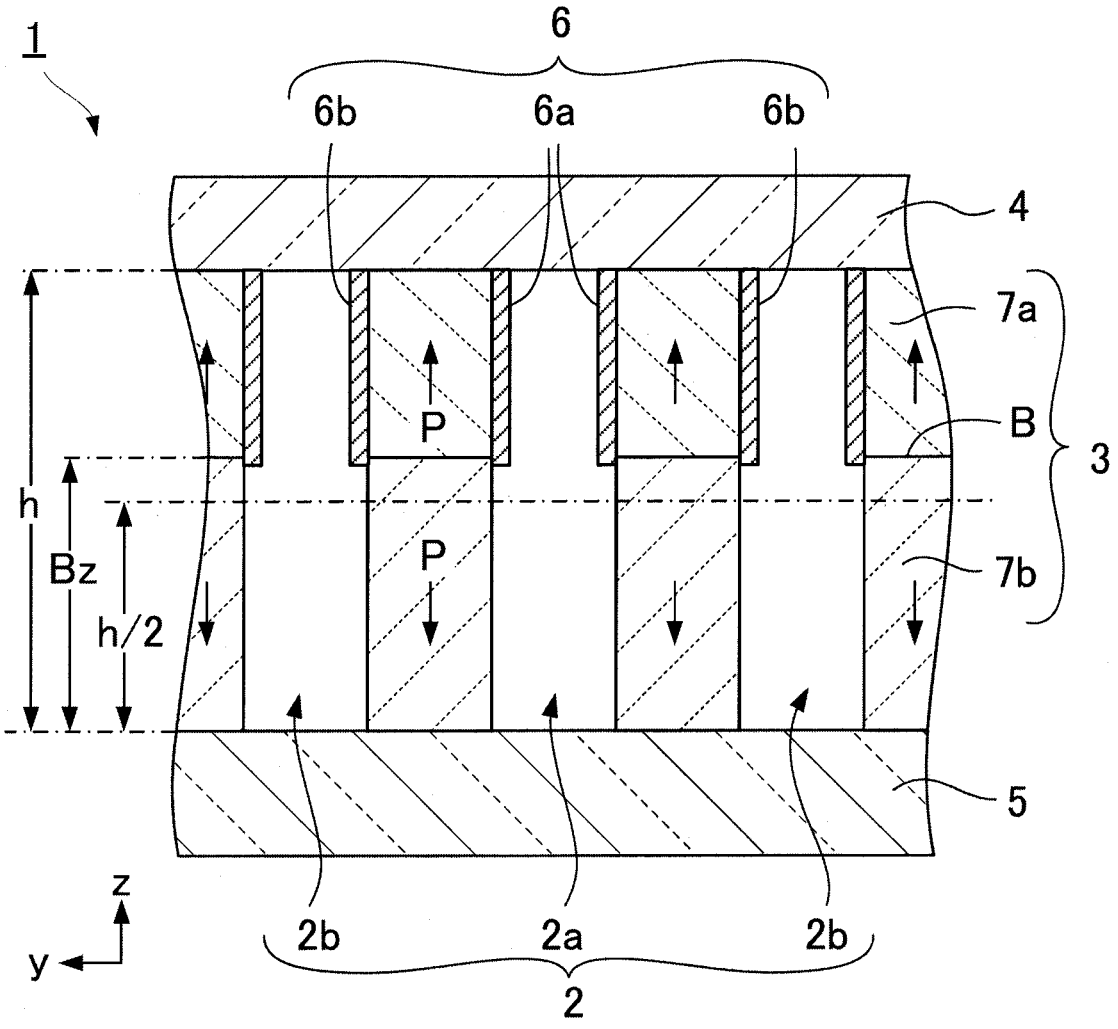
FIG. 1 is a schematic cross-sectional view of channels applied to a liquid jet head according to a first embodiment of the present invention.

FIG. 1 is a schematic cross-sectional view of channels applied to a liquid jet head 1 according to a first embodiment of the present invention. The first embodiment represents a basic configuration of the present invention. As illustrated in FIG. 1, the liquid jet head 1 includes a channel 2, a side wall 3 made of a piezoelectric material and arranged between the channels 2, an upper member 4 fixed to an upper end of the side wall 3 and installed on an upper portion of the channel 2, a lower member 5 fixed to a lower end of the side wall 3 and installed on a lower portion of the channel 2, and an electrode 6 installed on a wall surface of the side wall 3. The side wall 3 has two piezoelectric materials having mutually different polarization directions and laminated in a height direction (z direction), interposing a polarization boundary B. A height Bz of the polarization boundary B is positioned above h/2 of a height h of the side wall 3. The electrode 6 is installed from an upper end of the wall surface to a vicinity of the polarization boundary B or below the polarization boundary B and above a lower end of the wall surface. Here, the "vicinity of the polarization boundary B" includes not only slightly above the position of the polarization boundary B, but also slightly below the position of the polarization boundary B (the same applies to the description below).

As described above, the height Bz of the polarization boundary B is installed above h/2 of the height h of the side wall 3, so that an amount of displacement of the side wall 3 in a y direction can be optimized into a level sufficient to eject liquid droplets. Therefore, an oblique vapor deposition method can be applied, which is difficult to deposit a material deeply below the side wall 3, and the electrodes 6 can be simply and easily formed.

As the side wall 3, the piezoelectric material is used, and for example, lead zirconate titanate (PZT) ceramic can be used. In the side wall 3, one piezoelectric material (upper piezoelectric body substrate 7*a*) is polarized in a vertical direction of a surface of the upper member 4 and the other piezoelectric material (lower piezoelectric body substrate 7*b*) is polarized (P) in a direction opposite to the one material, interposing the polarization boundary B. As the upper member 4, a plastic material, a metal material, a ceramic material, or the like is used. The upper member 4 may be a nozzle plate, or a cover plate, for example. When the upper member 4 is a nozzle plate, a polyimide film or other plastic materials can be used. When the upper member 4 is a cover plate, a PZT ceramic or other ceramic materials, a plastic material, or the like can be used. As the electrode 6, a conductive material made of a metal material or a semiconductor material is used, and the electrode 6 can be formed by means of an oblique vapor deposition method. For example, Ti, Ni, Al, Au, Ag, Si, C, Pt, Ta, Sn, or In can be used. The length of the channel 2 is 3 to 8 mm in a depth direction of the paper surface, the width of the channel 2 is 30 to 100 μm, and the height h of the channel 2 (the height h is the same as the height h of the side wall 3) is 250 to 400 μm.

Specific description will be given. The channel 2 includes an ejection channel 2*a* that ejects the liquid droplets and a non-ejection channel 2*b* that does not eject the liquid droplets, and the ejection channel 2*a* and the non-ejection channel 2*b* are alternately arrayed in the y direction. The side wall 3 is installed between the ejection channel 2*a* and the non-ejection channel 2*b*. The electrode 6 includes a common electrode 6*a* installed on the wall surface facing the ejection channel 2*a*, and an individual electrode 6*b* installed on the wall surface facing the non-ejection channel 2*b*. The individual electrode 6*b* is installed from an upper end of a wall surface of the non-ejection channel 2*b*, to the polarization boundary B or below the polarization boundary B and above a lower end of the wall surface. The common electrode 6*a* is installed from the upper end of the wall surface, to a vicinity of the polarization boundary B, or below the polarization boundary B and above the lower end of the side wall 3. The upper member 4 can have mechanical strength lower than the lower member 5. For example, as the upper member 4, a nozzle plate made of a polyimide film or a metal thin plate can be used, and as the lower member 5, a PZT ceramic can be used. Note that, even when the upper member 4 and the lower member 5 use the same material, if the upper member 4 is thin and the lower member 5 is thick, the upper member 4 has lower mechanical strength than the lower member 5.

Here, technical effects of employing the "vicinity of the polarization boundary B" will be described. A potential difference is provided between the electrodes 6 on the side wall 3 of the present embodiment, and an electric field is applied to the piezoelectric body (side wall 3). In this case, the electric field expands not only to a range where the electrode of the piezoelectric body is formed, but also to a range where the electrode of the piezoelectric body is not formed (a lower side of the common electrode 6*a* in FIG. 1). Therefore, in the present embodiment, if the range of the lower side of the common electrode 6*a* is caused to be the "vicinity of the polarization boundary B", the electric field is applied to the lower side of the common electrode 6*a*, where the common electrode 6*a* is not formed, and the side wall 3 can be driven, using so-called a "leaking electric field", even if the common electrode 6*a* is interrupted at an upper side of the polarization boundary B.

Next, cost down can be expected by forming such common electrode 6*a* and individual electrode 6*b* by means of an oblique vapor deposition method, compared with a plating method. That is, with the plating method, a film thickness of a plating layer is thick, and for example, the conductive material is attached to all of the wall surfaces of the side walls 3 that configure the channels 2 and the conductive material by plating is attached to a surface on a side opposite in the z direction to the surface where the channels 2 of the piezoelectric body substrate 7 are included. Therefore, a consumption cost of the electrode material such as expensive gold becomes large. In contrast, with the oblique vapor deposition method, the range where the conductive material is formed is limited to a deposition surface, and therefore, the consumption cost of the electrode material is less expensive than the plating method.

The liquid jet head 1 is driven as follows. First, a liquid is filled in the ejection channel 2*a*. Then, the common electrode 6*a* is set to a GND potential, and a drive voltage is applied to the individual electrodes 6*b* at the ejection channel 2*a* side, of the two non-ejection channels 2*b* adjacent to the ejection channel 2*a*. Then, the two side walls 3 that interpose the ejection channel 2*a* are subjected to thickness slip deformation and are bent double, and expand the volume of the ejection channel 2*a*, and the liquid is drawn into the ejection channel 2*a*. Next, the individual electrode 6*b* is returned to the GND potential, the two side walls 3 that interpose the ejection channel 2*a* are returned to the original positions, and a pressure wave is induced to the liquid. The pressure wave is transferred to nozzles (not illustrated), and the liquid droplets are ejected through the nozzles.

Figure 2A:
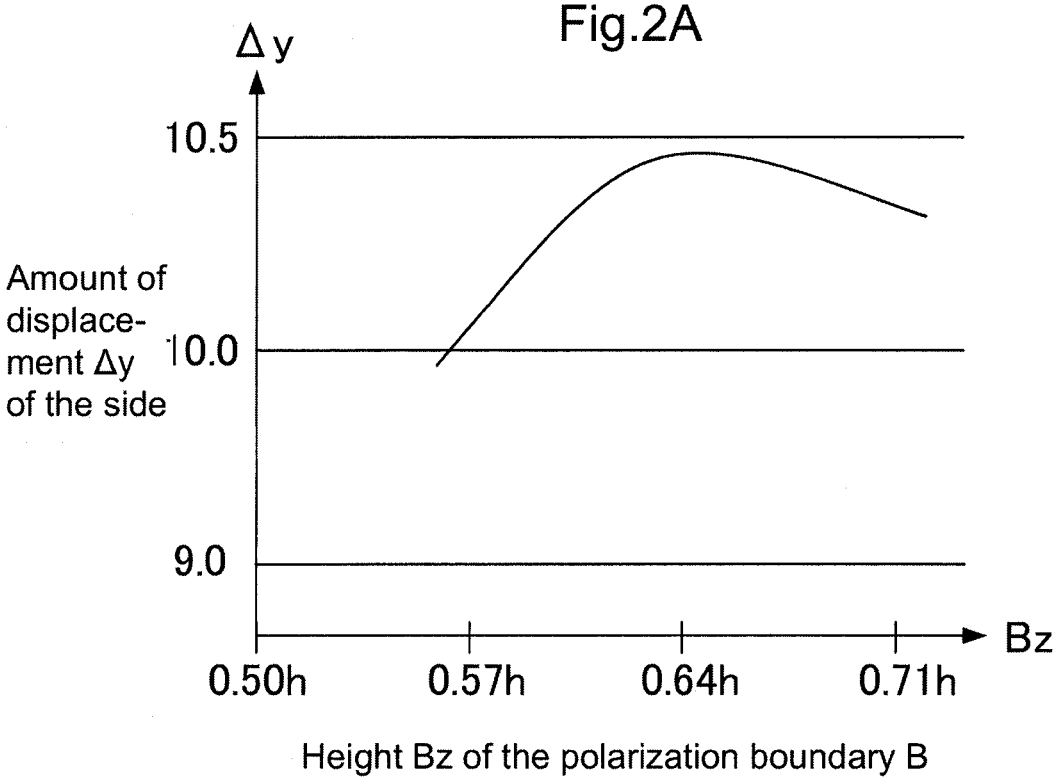
FIGS. 2A and 2B are diagrams for describing a relationship between the height of a polarization boundary of a side wall and an amount of displacement of the side wall.
Figure 2B:
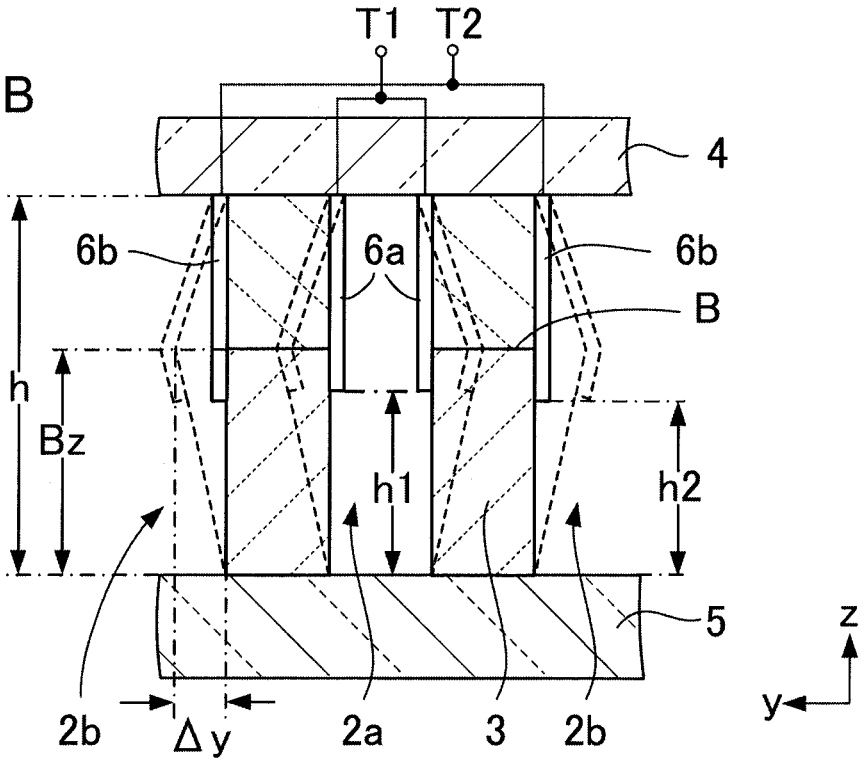

FIGS. 2A and 2B are diagrams for describing a relationship between the height Bz of the polarization boundary B of the side wall 3 and the amount of displacement Δy of the side wall 3. FIG. 2A is a simulation result indicating the amount of displacement Δy of the side wall 3 in the y direction when the lower ends of the common electrode 6*a* and of the individual electrode 6*b* are fixed below the height Bz of the polarization boundary B, and the height Bz (z direction) of the polarization boundary B is changed. FIG. 2B is a schematic cross-sectional view of the ejection channel 2*a*. Bz, h, h1, and h2 are heights of the side wall 3 from the lower end. A terminal T1 is electrically connected to the two common electrodes 6*a* installed on the wall surfaces facing the ejection channel 2*a*, and a terminal T2 is electrically connected to the two individual electrodes 6*b* installed on the wall surfaces at the ejection channel 2*a* side, of the two non-ejection channels 2*b* that interpose the ejection channel 2*a*. The solid lines illustrate a state of the side wall 3 before the voltage is applied between the terminals T1 and T2, and the broken lines indicate a state of the side wall 3 when the terminal T1 is connected to the GND, and the voltage is applied to the terminal T2. In FIG. 2A, the horizontal axis represents the height Bz of the polarization boundary B, and the vertical axis represents the amount of displacement Δy of the side wall 3 in the y direction. Ejection, efficiency of the liquid droplets is improved as the amount of displacement Δy becomes larger.

Here, the lower ends of the common electrode 6*a* and of the individual electrode 6*b* are fixed to a height, which is below a height of when the height Bz of the polarization boundary B becomes lowest. In the above simulation, the lower ends of the common electrode 6*a* and of the individual electrode 6*b* are roughly fixed to the height of h/2. Note that a nozzle plate made of a polyimide film is used as the upper member 4, a material having sufficiently higher mechanical strength than the upper member 4 is used as the lower member 5, and a PZT ceramic is used as the side wall 3. A portion upper than the polarization boundary B, of the side wall 3 is polarized in the z direction, and a portion lower than the polarization boundary B is polarized in the −z direction.

From the graph illustrated in FIG. 2A, the height Bz of the polarization boundary B that maximizes the amount of displacement Δy is 0.6 to 0.7 h. That is, the position (height Bz) of the polarization boundary B that maximizes the ejection efficiency of the liquid droplets exists above h/2 of the height h of the side wall 3, under the condition that the upper member 4 has sufficiently lower mechanical strength than the lower member S. Note that, from another simulation result, when the common electrode 6*a* is set to the GND potential, and the drive voltage is applied to the individual electrode 6*b* to drive the side wall 3, the amount of displacement Δy of the side wall 3 becomes larger when the height h2 of the lower end of the individual electrode 6*b* is caused to be lower than the height h1 of the lower end of the common electrode 6*a* (h1>h2), rather than the opposite case (h2>h1). Therefore, the height h2 of the lower end of the individual electrode 6*b* is caused to satisfy the formula (1) so that the height h2 becomes the height Bz of the polarization boundary B or less, and becomes above the lower end of the side wall 3. Further, the height h1 of the lower end of the common electrode 6*a* is caused to satisfy the formula (2) so that the height h1 becomes a height in the vicinity of the height of the polarization boundary B (Bz−h/10 to Bz+h/10), or becomes below the height of the polarization boundary B and above the lower end of the side wall 3.

$$0<h2\leq Bz \quad (1)$$

$$0<h1\leq(Bz+h/10) \quad (2)$$

Second Embodiment

Figure 3A:
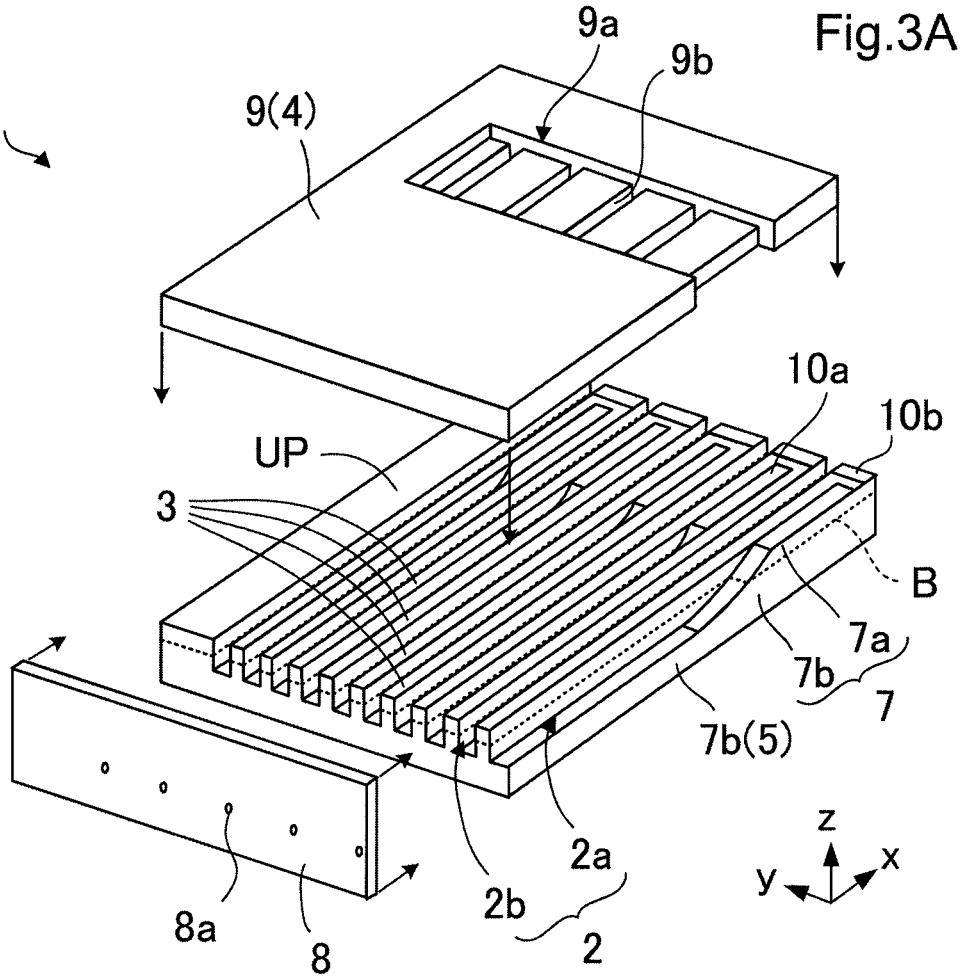
FIGS. 3A and 3B are explanatory diagrams of a liquid jet head according to a second embodiment of the present invention.
Figure 3B:
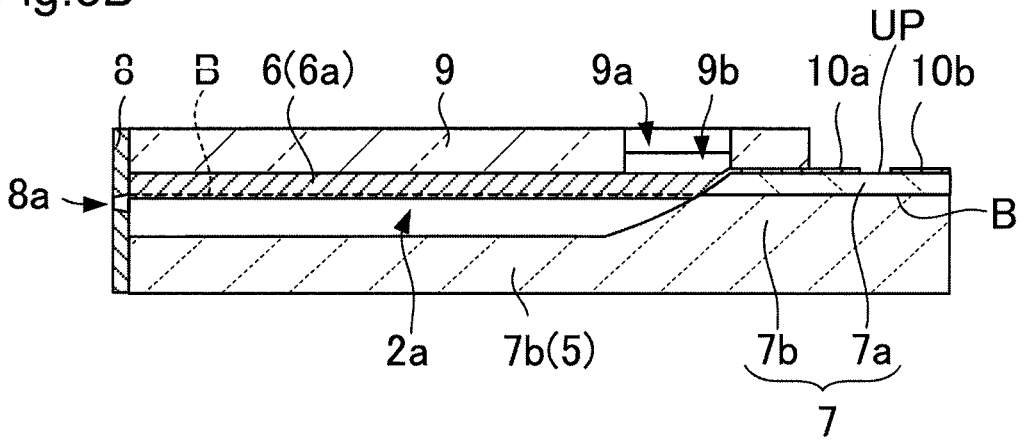

FIGS. 3A and 3B are explanatory diagrams of a liquid jet head 1 according to a second embodiment of the present invention. FIG. 3A is a schematic exploded perspective view of the liquid jet head 1, and FIG. 3B is a schematic cross-sectional view of an ejection channel 2*a* along a longitudinal direction (x direction). The liquid jet head 1 is an edge shoot-type liquid jet head. The same portions or portions having the same function are denoted with the same reference sign.

As illustrated in FIGS. 3A and 3B, the liquid jet head 1 includes a piezoelectric body substrate 7, a cover plate 9 installed on an upper surface UP of the piezoelectric body substrate 7, and a nozzle plate 8 installed at an end surface of one side of the piezoelectric body substrate 7. The ejection channel 2*a* and a non-ejection channel 2*b*, which are narrow and long in an x direction, are alternately formed in a y direction in the piezoelectric body substrate 7. A side wall 3 is installed between the ejection channel 2*a* and the non-ejection channel 2*b*. An end portion of one side of the ejection channel 2*a* in the x direction is open to the end surface of the one side of the piezoelectric body substrate 7, and the other end portion in the x direction rises to the upper surface UP and is formed short of an end surface of the other side of the piezoelectric body substrate 7. An end portion of one side of the non-ejection channel 2*b* in the x direction is open to the end surface of the one side of the piezoelectric body substrate 7, and an end portion of the other side in the x direction is open to the end surface of the other side of the piezoelectric body substrate 7.

The cover plate 9 includes a liquid chamber 9*a*, and a slit 9*b* is installed in the liquid chamber 9*a*. The liquid chamber 9*a* communicates with the end portion of the other side of the ejection channel 2*a* through the slit 9*b*. The nozzle plate 8 includes a nozzle 8*a*, and the nozzle 8*a* communicates with the ejection channel 2*a* that is open to the end surface of the one side of the piezoelectric body substrate 7. Here, a PZT ceramic can be used as the piezoelectric body substrate 7. A plastic material or a ceramic material can be used as the cover plate 9. A plastic material or a metal material can be used as the nozzle plate 8. A conductive material made of a metal material or a semiconductor material is used as the electrode 6, and the electrode 6 can be formed by means of an oblique vapor deposition method. For example, Ti, Ni, Al, Au, Ag, Si, C, Pt, Ta, Sn, or In can be used. The length of the channel 2 is 3 to 8 mm in the x direction, the width of the channel 2 is 30 to 100 μm, and the height h of the channel 2 is 250 to 400 μm.

In the piezoelectric body substrate 7, two piezoelectric materials having mutually different polarization directions are laminated in the height direction (z direction), interposing a polarization boundary B. To be specific, an upper piezoelectric body substrate 7*a* that is polarized in a vertical direction of the upper surface UP, and a lower piezoelectric body substrate 7*b* that is polarized in a direction opposite to the polarization direction of the upper piezoelectric body substrate 7*a* are laminated through an adhesive. The cover plate 9 is fixed to an upper end of the side wall 3, and is installed on upper portions of the ejection channel 2*a* and of the non-ejection channel 2*b*. The cover plate 9 functions as an upper member 4. The lower piezoelectric body substrate 7*b* below bottom surfaces of the ejection channel 2*a* and of the non-ejection channel 2*b* functions as a lower member 5. That is, the lower member 5 is fixed to a lower end of the side wall 3, and is installed on lower portions of the ejection channel 2*a* and of the non-ejection channel 2*b*.

An electrode 6 is installed on a wall surface of the side wall 3. The polarization boundary B is positioned above ½ the height of the side wall 3, and the electrode 6 is installed from an upper end of the wall surface, to a vicinity of the polarization boundary B, or below the polarization boundary B and above a lower end of the wall surface. The electrode 6 includes a common electrode 6*a* installed on the wall surface facing the ejection channel 2*a*, and an individual electrode 6*b* (not illustrated) installed on the wall surface facing the non-ejection channel 2*b*. The individual electrode 6*b* is installed from the upper end of the wall surface, to the polarization boundary B, or below the polarization boundary B and above the lower end of the wall surface. The electrode 6 satisfies the above-described formulas (1) and (2) where the height of the polarization boundary B from the lower end of the side wall 3 is Bz, the height of a lower end of the common electrode 6*a* is h1, the height of a lower end of the individual electrode 6*b* is h2, and the height of the side wall 3 from the lower end to the upper end is h.

A common terminal 10*a* electrically connected to the common electrode 6*a*, and an individual terminal 10*b* electrically connecting the individual electrodes 6*b* installed on the wall surfaces at the ejection channel 2*a* side, of the two non-ejection channels 2*b* that interpose the ejection channel 2*a*, are included on the upper surface UP of a side opposite to the side where the nozzle plate 8 is installed, of the upper piezoelectric body substrate 7*a*. A drive voltage is applied between the common terminal 10*a* and the individual terminal 10*b*, so that the two side walls 3 that interpose the ejection channel 2*a* are subjected to thickness slip deformation, a pressure wave is caused in a liquid filled in the ejection channel 2*a*, and when the pressure wave reaches the nozzle 8*a*, liquid droplets are ejected through the nozzle 8*a*.

As described above, when the electrode 6 is installed from the upper end of the wall surface, to above the lower end of the wall surface, the height Bz of the polarization boundary B is installed above ½ the height of the side wall 3, whereby an amount of displacement of the side wall 3 in the y direction can be optimized to a level sufficient to eject the liquid droplets. Even if mechanical strength of the cover plate 9 as the upper member 4 is lower than that of the lower piezoelectric body substrate 7*b* as the lower member 5, an amount of change of the volume of the ejection channel 2*a* can be made large. Further, the oblique vapor deposition method that is hard to form the common electrode 6*a* and the individual electrode 6*b* deeply below the side wall 3 can be applied, and therefore, the common electrode 6*a* and the individual electrode 6*b* can be simply and easily formed.

Third Embodiment

FIGS. 4A and 4B are explanatory diagrams of a liquid jet head 1 according to a third embodiment of the present invention. FIG. 4A is a schematic exploded perspective view of the liquid jet head 1, and FIG. 4B is a schematic cross-sectional view of an ejection channel 2*a* along a longitudinal direction (x direction). The liquid jet head 1 is a side shoot-type liquid jet head. The same portions or portions having the same function are denoted with the same reference sign.

As illustrated in FIGS. 4A and 4B, the liquid jet head 1 includes a piezoelectric body substrate 7, a nozzle plate 8 installed on an upper surface UP of the piezoelectric body substrate 7, and a cover plate 9 installed on a lower surface LP of the piezoelectric body substrate 7. The ejection channel 2*a* and a non-ejection channel 2*b*, which are long and narrow in the x direction, are alternately formed in a y direction in the piezoelectric body substrate 7. A side wall 3 is installed between the ejection channel 2*a* and the non-ejection channel 2*b*. The ejection channel 2*a* and the non-ejection channel 2*b* penetrate in a plate thickness direction of the piezoelectric body substrate 7. The ejection channel 2*a* is formed from a position in short of an end portion of one side of the piezoelectric body substrate 7 in the x direction to in short of an end portion of the other side in the x direction. A central portion of the ejection channel 2*a* is open with a long and narrow shape in the x direction of the upper surface UP, and both end portions form tapered slopes from the upper surface UP to the lower surface LP. A central portion of the non-ejection channel 2*b* has an upside-down shape of the ejection channel 2*a*, and both end portions have a certain depth from the upper surface UP and are extended to both end surfaces of the piezoelectric body substrate 7. That is, the non-ejection channel 2*b* is open from an end portion of one side to an end portion of the other side of the upper surface UP.

The cover plate 9 includes two liquid chambers 9*a*, and one liquid chamber 9*a* communicates with one end portion of the ejection channel 2*a*, and the other liquid chamber 9*a* communicates with the other end portion of the ejection channel 2*a*. The non-ejection channel 2*b* is not open to an opening region at the lower piezoelectric body substrate 7*b* side, to which the two liquid chambers 9*a* are open. Therefore, it is not necessary to provide a slit to the two liquid chambers 9*a*. The nozzle plate 8 includes a nozzle 8*a*, and the nozzle 8*a* communicates with the ejection channel 2*a* that is open to the upper surface UP. Here, a PZT ceramic can be used as the piezoelectric body substrate 7. A PZT ceramic, other ceramic materials, or other plastic materials can be used as the cover plate 9. A plastic material such as polyimide film or a metal material can be used as the nozzle plate 8. A conductive material made of a metal material or a semiconductor material is used as the electrode 6, and the electrode 6 can be formed by means of an oblique vapor deposition method. For example, Ti, Ni, Al, Au, Ag, Si, C, Pt, Ta, Sn, or In can be used. The length of the channel 2 is 3 to 8 mm in the x direction, the width of the channel 2 is 30 to 100 μn, and the height of the channel 2 is 250 to 400 μm.

In the piezoelectric body substrate 7, two piezoelectric materials having mutually different polarization directions are laminated in a height direction (z direction), interposing a polarization boundary B. To be specific, an upper piezoelectric body substrate 7*a* that is polarized in a vertical direction of the upper surface UP, and a lower piezoelectric body substrate 7*b* that is polarized in a direction opposite to the polarization direction of the upper piezoelectric body substrate 7*a* are laminated through an adhesive. The nozzle plate 8 is fixed to an upper end of the side wall 3, and is installed on upper portions of the ejection channel 2*a* and of the non-ejection channel 2*b*. The nozzle plate 8 functions as an upper member 4. The cover plate 9 is fixed to a lower end of the side wall 3, and is installed on lower portions of the ejection channel 2*a* and of the non-ejection channel 2*b*. The cover plate 9 functions as a lower member 5.

The electrode 6 is installed on a wall surface of the side wall 3. The polarization boundary B is positioned above ½ the height of the side wall 3, and the electrode 6 is installed from an upper end of the wall surface, to a vicinity of the polarization boundary B, or below the polarization boundary B and above a lower end of the wall surface. The electrode 6 includes a common electrode 6*a* installed on the wall surface facing the ejection channel 2*a*, and an individual electrode 6*b* installed on the wall surface facing the non-ejection channel 2*b*. The individual electrode 6*b* is installed from the upper end of the wall surface, to the polarization boundary B, or below the polarization boundary B and above the lower end of the wall surface. The electrode 6 satisfies the above-described formulas (1) and (2) where the height of the polarization boundary B from the lower end of the side wall 3 is Bz, the height of a lower end of the common electrode 6*a* is h1, the height of a lower end of the individual electrode 6*b* is h2, and the height of the side wall 3 from the lower end to the upper end is h.

A common terminal 10*a* electrically connected to the common electrode 6*a*, and an individual terminal 10*b* electrically connecting the individual electrodes 6*b* installed on the wall surfaces at the ejection channel 2*a* side, of the two non-ejection channels 2*b* that interpose the ejection channel 2*a*, are provided on the upper surface UP at a side where the nozzle plate 8 is installed, of the upper piezoelectric body substrate 7*a*. A drive voltage is applied between the common terminal 10*a* and the individual terminal 10*b*, so that the two side walls 3 that interpose the ejection channel 2*a* are subjected to thickness slip deformation, a pressure wave is caused to a liquid filled in the ejection channel 2*a*, and when the pressure wave reaches a nozzle 8*a*, liquid droplets are ejected through the nozzle 8*a*.

As described above, when the electrode 6 is installed from the upper end of the wall surface, to above the lower end of the wall surface, the height Bz of the polarization boundary B is installed above ½ the height of the side wall 3, whereby an amount of displacement of the side wall 3 in the y direction can be optimized to a level sufficient to eject the liquid droplets. Even if mechanical strength of the nozzle plate 8 as the upper member 4 is lower than that of the cover plate 9 as the lower member 5, an amount of change of the volume of the ejection channel 2*a* can be made large. Further, the oblique vapor deposition method that is hard to form the common electrode 6*a* and the individual electrode 6*b* deeply below the side wall 3 can be applied, and therefore, the common electrode 6*a* and the individual electrode 6*b* can be simply and easily formed.

Fourth Embodiment

Figure 5:
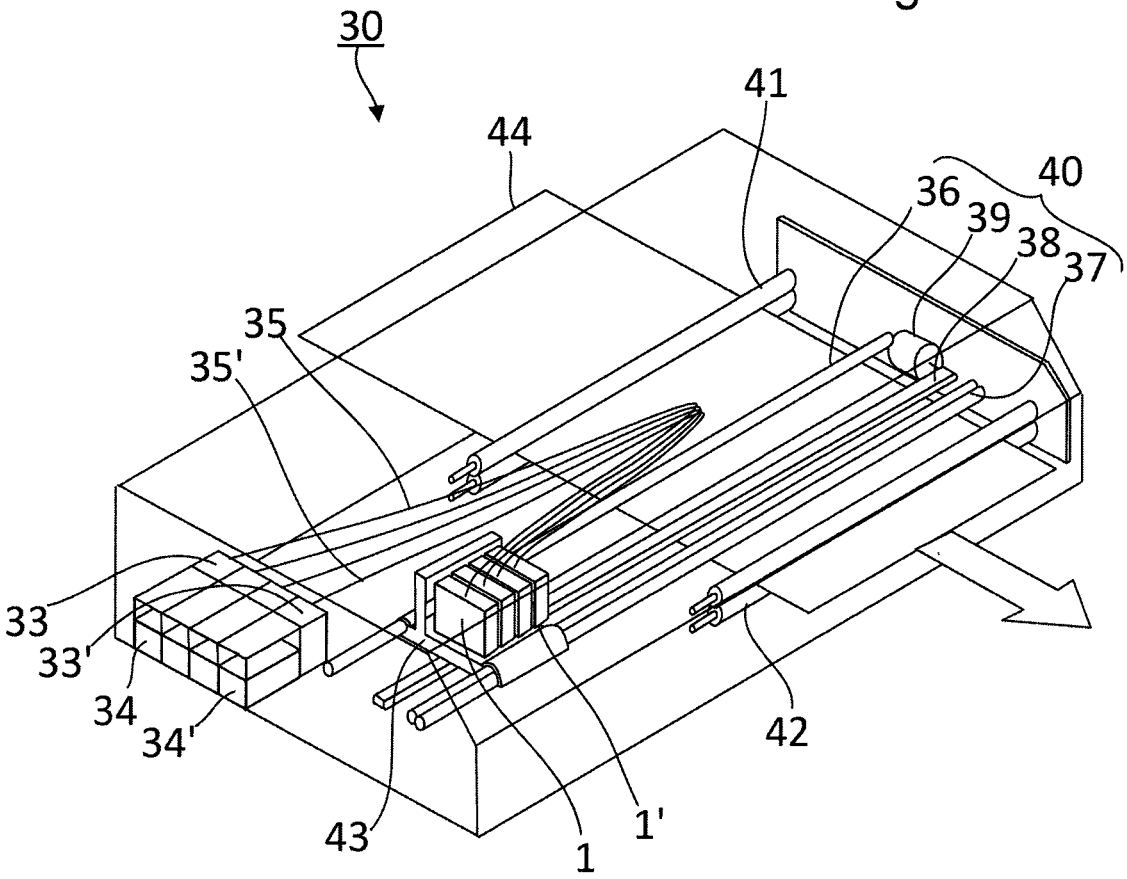
FIG. 5 is a schematic perspective view of a liquid jet apparatus according to a fourth embodiment of the present invention.
Figure 6:
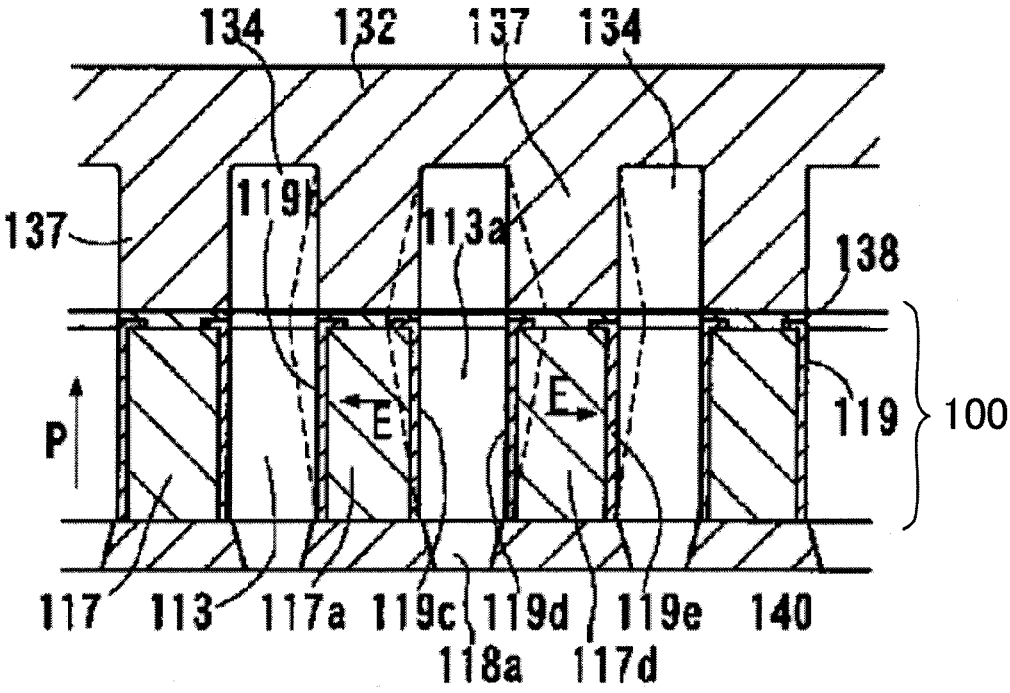
Fig.6 Prior art
FIG. 6 is a schematic cross-sectional view of jet channels of a conventionally known liquid jet apparatus.

FIG. 5 is a schematic perspective view of a liquid jet apparatus 30 according to a fourth embodiment of the present invention. The liquid jet apparatus 30 includes a moving mechanism 40 that reciprocates liquid jet heads 1 and 1', flow path portions 35 and 35' that supply a liquid to the liquid jet heads 1 and 1', and discharge the liquid from the liquid jet heads 1 and 1', liquid pumps 33 and 33' that communicate with the flow path portions 35 and 35', and liquid tanks 34 and 34'. As each of the liquid jet heads 1 and 1', any of the liquid jet heads in the first to third embodiments described above is used.

The liquid jet apparatus 30 includes a pair of conveyance units 41 and 42 that convey a recording medium 44 such as paper in a main scanning direction, the liquid jet heads 1 and 1' that eject the liquid to the recording medium 44, a carriage unit 43 on which the liquid jet heads 1 and 1' are placed, the liquid pumps 33 and 33' that press and supply the liquid stored in the liquid tanks 34 and 34' to the flow path portions 35 and 35', and the moving mechanism 40 that scans the liquid jet heads 1 and 1' in a sub-scanning direction that is perpendicular to the main scanning direction. A control unit (not illustrated) controls and drives the liquid jet heads 1 and 1', the moving mechanism 40, and the conveyance units 41 and 42.

The pair of conveyance units 41 and 42 is extended in the sub-scanning direction, and includes a grid roller and a pinch roller that are rotated on a roller surface, being in contact with each other. The conveyance units 41 and 42 move the grid roller and the pinch roller around an axis by a motor (not illustrated), and convey the recording medium 44 sandwiched between the rollers, in the main scanning direction. The moving mechanism 40 includes a pair of guide rails 36 and 37 extending in the sub-scanning direction, the carriage unit 43 that can slide along the pair of guide rails 36 and 37, an endless belt 38 that couples and moves the carriage unit 43 in the sub-scanning direction, and a motor 39 that allows the endless belt 38 to go around through a pulley (not illustrated).

The carriage unit 43 places the plurality of liquid jet heads 1 and 1' thereon, and for example, ejects four types of liquid droplets: yellow, magenta, cyan, and black. The liquid tanks 34 and 34' store the liquids of corresponding colors, and supply the liquids to the liquid jet heads 1 and 1' through the liquid pumps 33 and 33' and the flow path portions 35 and 35'. Each of the liquid jet heads 1 and 1' ejects the liquid droplets of each color according to a drive signal. The timing at which the liquids are ejected from the liquid jet heads 1 and 1', the rotation of the motor 39 that drives the carriage unit 43, and the conveyance speed of the recording medium 44 are controlled, whereby an arbitrary pattern can be recorded on the recording medium 44.

Note that the present embodiment is the liquid jet apparatus 30 that allows the moving mechanism 40 moves the carriage unit 43 and the recording medium 44 to perform recording. However, a liquid jet apparatus in which the carriage unit is fixed, and which allows the moving mechanism to two-dimensionally move the recording medium to perform recording may be employed, in place of the above embodiment. That is, the moving mechanism may just relatively move the liquid jet head and the recording medium.

What is claimed is:

1. A liquid jet head comprising:

a side wall disposed between an ejection channel that ejects liquid droplets and a non-ejection channel that does not eject liquid droplets, and in which two piezoelectric materials having mutually different polarization directions are laminated in a height direction, interposing a polarization boundary;

an upper member fixed to an upper end of the side wall and installed on an upper portion of the channels;

a lower member fixed to a lower end of the side wall and installed on a lower portion of the channels; and an electrode installed on a wall surface of the side wall, wherein the polarization boundary is positioned above ½ a depth of the ejection channel, and the electrode is installed from an upper end of the wall surface, to a vicinity of the polarization boundary, or below the polarization boundary and above a lower end of the wall surface.

2. The liquid jet head according to claim 1, wherein the electrode includes an individual electrode installed on a portion of the wall surface within the non-ejection channel, and a common electrode installed on another portion of the wall surface within the ejection channel, and the individual electrode is installed from the upper end of the wall surface of the non-ejection channel, to the polarization boundary, or below the polarization boundary and above the lower end of the wall surface of the non-ejection channel.

3. The liquid jet head according to claim 1, wherein the upper member has lower mechanical strength than the lower member.

4. The liquid jet head according to claim 1, wherein the upper member is a nozzle plate in which a nozzle that ejects the liquid droplets is formed, and the lower member is a cover plate.

5. The liquid jet head according to claim 1, wherein the upper member is a cover plate, and the lower member is made of the piezoelectric material.

6. The liquid jet head according to claim 1, wherein the electrode is made of a conductive material formed by an oblique vapor deposition method.

7. A liquid jet apparatus comprising:

a liquid jet head according to claim 1;

a moving mechanism that relatively moves the liquid jet head and a recording medium;

a liquid supply tube that supplies a liquid to the liquid jet head; and a liquid tank that supplies the liquid to the liquid supply tube.

8. A liquid jet head comprising:

a plurality of spaced-apart side walls defining therebetween alternating ejection channels and non-ejection channels, the side walls comprising two piezoelectric materials that are polarized in opposite directions and that are laminated together in a height direction of the channels so that a polarization boundary exists between the two piezoelectric materials;

an upper member fixed to upper ends of the side walls and overlying upper ends of the channels;

a lower member fixed to lower ends of the side walls and overlying lower ends of the channels; and electrodes disposed on wall surfaces of the side walls and extending from the upper ends of the side walls to either a vicinity of the polarization boundary or to below the polarization bondary and above the lower ends of the side walls, wherein the polarization boundary is positioned above one-half the height of the ejection channels.

9. The liquid jet head according to claim 8, wherein the electrodes comprise individual electrodes disposed on opposed wall surfaces of each of the non-ejection channels, the individual electrodes extending from the upper ends of the side walls to either the polarization boundary or to below the polarization boundary and above the lower ends of the side walls; and common electrodes disposed on opposed wall surfaces of each of the ejection channels.

10. The liquid jet head according to claim 8; wherein the polarization boundary is positioned above 0.6 the height of the ejection channels.

11. The liquid jet head according to claim 8; wherein the polarization boundary is positioned above 0.6 to 0.7 the height of the ejection channels.

12. The liquid jet head according to claim 8; wherein the electrodes extend only to the vicinity of the polarization boundary.

13. The liquid jet head according to claim 8; wherein the upper member has a lower mechanical strength than that of the lower member.

14. The liquid jet head according to claim 8, wherein the upper member is a nozzle plate in which a nozzle that ejects the liquid droplets is formed, and the lower member is a cover plate.

15. The liquid jet head according to claim 8; wherein the upper member is a cover plate, and the lower member is made of piezoelectric material.

16. The liquid jet head according to claim 8; wherein the electrodes comprise oblique vapor deposited electrodes.

17. The liquid jet head according to claim 8; wherein lower ends of the electrodes terminate at either the vicinity of the polarization boundary or below the polarization boundary and above the lower ends of the side walls.

18. A liquid jet apparatus comprising:

a liquid jet head according to claim 8;

a moving mechanism that relatively moves the liquid jet head and a recording medium;

a liquid supply tube that supplies a liquid to the liquid jet head; and a liquid tank that supplies the liquid to the liquid supply tube.

* * * * *